US008149195B2

(12) United States Patent
Oh et al.

(10) Patent No.: US 8,149,195 B2
(45) Date of Patent: Apr. 3, 2012

(54) METHOD AND APPARATUS FOR DRIVING LIQUID CRYSTAL DISPLAY DEVICE

(75) Inventors: Eui Yeol Oh, Gyeonggi-do (KR); Min Ho Sohn, Gyeonggi-do (KR); Ki Duk Kim, Gyeonggi-do (KR); Seong Ho Baik, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 115 days.

(21) Appl. No.: 12/839,900

(22) Filed: Jul. 20, 2010

(65) Prior Publication Data

US 2010/0277518 A1 Nov. 4, 2010

Related U.S. Application Data

(62) Division of application No. 11/022,688, filed on Dec. 28, 2004, now Pat. No. 7,782,281.

(30) Foreign Application Priority Data

Dec. 29, 2003 (KR) ..... 10-2003-0099334

(51) Int. Cl.
*G09G 3/36* (2006.01)

(52) U.S. Cl. ..... 345/87; 345/77; 345/690

(58) Field of Classification Search ..... 345/76–77, 345/83–102, 690, 204, 210–214, 698–699; 348/669–673; 315/169.3
See application file for complete search history.

(56) References Cited

U.S. PATENT DOCUMENTS 6,278,436 B1 8/2001 Hosoi et al.
6,778,160 B2 8/2004 Kubota et al.
6,795,053 B1 9/2004 Funamoto et al.
6,873,729 B2 3/2005 Matsushima
7,170,477 B2 * 1/2007 Okamoto et al. ..... 345/77
7,173,163 B2 * 2/2007 Lee et al. ..... 800/278
7,275,719 B2 * 10/2007 Olson ..... 244/155 A
7,289,100 B2 * 10/2007 Sohn et al. ..... 345/102
7,352,352 B2 * 4/2008 Oh et al. ..... 345/102
7,375,711 B2 5/2008 Horiuchi et al.
7,782,281 B2 * 8/2010 Oh et al. ..... 345/77
2001/0033260 A1 10/2001 Nishitani et al.
2002/0057238 A1 5/2002 Nitta et al.
2003/0002736 A1 1/2003 Maruoka et al.
2003/0016205 A1 1/2003 Kawabata et al.
2004/0036703 A1 2/2004 Aoki et al.
2004/0246242 A1 12/2004 Sasaki
2005/0052388 A1 3/2005 Handschy et al.

FOREIGN PATENT DOCUMENTS

EP 1 255 241 A1 11/2002
(Continued)

*Primary Examiner* — Amare Mengistu
*Assistant Examiner* — Mansour M Said
(74) *Attorney, Agent, or Firm* — McKenna Long & Aldridge, LLP

(57) ABSTRACT

A method of driving a liquid crystal display device includes extracting brightness components of a portion of the first data for a current frame, arranging the brightness components for the current frame into a brightness histogram, retrieving brightness histograms for at least two frames prior to the current frame to generate an average histogram, generating second data for the current frame based on the average histogram, comparing the histogram for the current frame with the average histogram to determine whether an image at the current frame is a moving image or a still image, and driving the liquid crystal display device in accordance with one of the first data and the second data based on the comparison result.

20 Claims, 12 Drawing Sheets

FOREIGN PATENT DOCUMENTS

| | | |
|---|---|---|
| JP | 2001-343957 | 12/2001 |
| JP | 2002-202767 | 7/2002 |
| JP | 2002-208307 | 7/2002 |
| JP | 2003-345315 | 12/2003 |
| JP | 2006-508387 | 3/2006 |
| KR | 10-2001-0099588 | 11/2001 |
| KR | 2002/0067852 A | 8/2002 |
| KR | 10-2003-0062659 | 7/2003 |

* cited by examiner

METHOD AND APPARATUS FOR DRIVING LIQUID CRYSTAL DISPLAY DEVICE

CROSS-REFERENCE TO RELATED APPLICATIONS

This application is a Divisional of application Ser. No. 11/022,688 filed Dec. 28, 2004 now U.S. Pat. No. 7,782,281, now allowed, which claims priority to Korean Patent Application No. 10-2003-0099334, filed Dec. 29, 2003, all of which are hereby incorporated by reference for all purposes as if fully set forth herein.

BACKGROUND OF THE INVENTION

1. Field of the Invention

The present invention relates to a liquid crystal display device, and more particularly, to a method and an apparatus for driving a liquid crystal display device that adjust brightness of light generated by a back light device to improve a contrast ratio of a moving image.

2. Discussion of the Related Art

In general, a liquid crystal display (LCD) device controls light transmittance of liquid crystal cells in accordance with data signals applied thereto, to thereby display an image. In particular, an active matrix type LCD device includes a switching device for each cell and has various applications, such as a monitor for a computer, office equipment, and a cellular phone, because of their high quality image, lightness, thin thickness, compact size, and low power consumption. A thin film transistor (TFT) is generally employed as the switching device for the active matrix type LCD device.

FIG. 1 is a schematic block diagram illustrating a driving apparatus for a liquid crystal display device according to the related art. In FIG. 1, an LCD driving apparatus includes a liquid crystal display panel 2 having m×n liquid crystal cells Clc arranged in a matrix-like manner at intersections between data lines D1 . . . Dm and gate lines G1 . . . Gn, a data driver 4 for applying data signals to the data lines D1 . . . Dm, a gate driver 6 for applying gate signals to the gate lines G1 . . . Gn and a dummy gate line G0, and a gamma voltage supplier 8 for supplying gamma voltages to the data driver 4, and a timing controller 10 for controlling the data driver 4 and the gate driver 6 using signals applied from a system 20.

In addition, each of the liquid crystal cells Clc includes a thin film transistor TFT. The thin film transistor TFT applies a data signal from a respective one of the data lines D1 . . . Dm to the liquid crystal cell Clc in response to a scanning signal from a respective one of the gate lines G1 . . . Gn. Each of the liquid crystal cells Clc also includes a storage capacitor Cst. The storage capacitor Cst maintains a voltage of the liquid crystal cell Clc.

Further, the data driver 4 converts digital video data R, G and B into analog gamma voltages, i.e., data signals, corresponding to gray level values in response to a control signal CS from the timing controller 10, and applies the analog gamma voltages to the data lines D1 . . . Dm. The gate driver 6 sequentially applies a scanning pulse to the gate lines G1 . . . Gn in response to the control signal CS from the timing controller 10, to thereby select horizontal lines of the liquid crystal display panel 2 to be supplied with the data signals.

The system 20 applies vertical/horizontal synchronizing signals Vsync and Hsync, a clock signal DCLK and a data enable signal DE to the timing controller 10. Further, the system 20 controls a power supply 12. In particular, the LCD driving apparatus includes a DC/DC converter 14 for boosting or dropping a voltage of 3.3V inputted from the power supply 12. Thus, the DC/DC converter 14 generates a gamma reference voltage, a gate high voltage VGH, a gate low voltage VGL and a common voltage Vcom (not shown).

Moreover, the timing controller 10 generates the control signal CS for the data driver 4 and the gate driver 6 using the vertical/horizontal synchronizing signals Vsync and Hsync, the clock signal DCLK and the data enable signal DE inputted from the system 20. Although not shown, the control signal CS for the gate driver 6 includes a gate start pulse GSP, a gate shift clock GSC and a gate output enable signal GOE, and the control signal CS for the data driver 4 includes a source start pulse SSP, a source shift clock SSC, a source output enable signal SOE and a polarity control signal POL. The timing controller 10 also re-aligns the video data R, G and B from the system 20 before applying them to the data driver 4.

Furthermore, the LCD driving apparatus includes an inverter 16 for driving a back light 18. The inverter 16 applies a driving voltage or a driving current for driving the back light 18. The back light 18 generates light corresponding to the driving voltage or the driving current from the inverter 16 for the liquid crystal display panel 2.

In order to display a vivid image on the liquid crystal display panel 2, a distinct contrast between brightness and darkness must be made in correspondence with a data. However, since the back light 18 according to the related art produces the same degree of brightness irrespectively of a data, it was difficult to display a dynamic and fresh image.

SUMMARY OF THE INVENTION

Accordingly, the present invention is directed to a method and an apparatus for driving a liquid crystal display device that substantially obviate one or more of the problems due to limitations and disadvantages of the related art.

An object of the present invention is to provide a method and an apparatus for driving a liquid crystal display device wherein a contrast ratio of a data can be expanded and brightness of a back light can be changed in correspondence with a data when a moving picture is displayed.

Another object of the present invention is to provide a method and an apparatus for driving a liquid crystal display device that dynamically adjust a back light device to generate light having various degrees of brightness in accordance with a data.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, a method of driving a liquid crystal display device includes retrieving brightness histograms for at least two frames prior to a current frame to generate an average histogram, generating modulated brightness components based on the average histogram, and modulating first data for the current frame based on the modulated brightness components to generate second data for the current frame.

In another aspect, a method of driving a liquid crystal display device includes extracting brightness components of a portion of the first data for a current frame, arranging the brightness components for the current frame into a brightness histogram, retrieving brightness histograms for at least two frames prior to the current frame to generate an average histogram, generating second data for the current frame based on the average histogram, comparing the histogram for the current frame with the average histogram to determine whether an image at the current frame is a moving image or a still image, and driving the liquid crystal display device in accordance with one of the first data and the second data based on the comparison result.

In yet another aspect, a driving apparatus for a liquid crystal display device includes an image signal modulator receiving first data for a current frame, retrieving brightness histograms for at least two frames prior to the current frame to generate an average histogram, and generating second data for the current frame based on the average histogram, and a back light controller generating a brightness control signal based on the average histogram.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments, examples of which are illustrated in the accompanying drawings.

Figure 1:
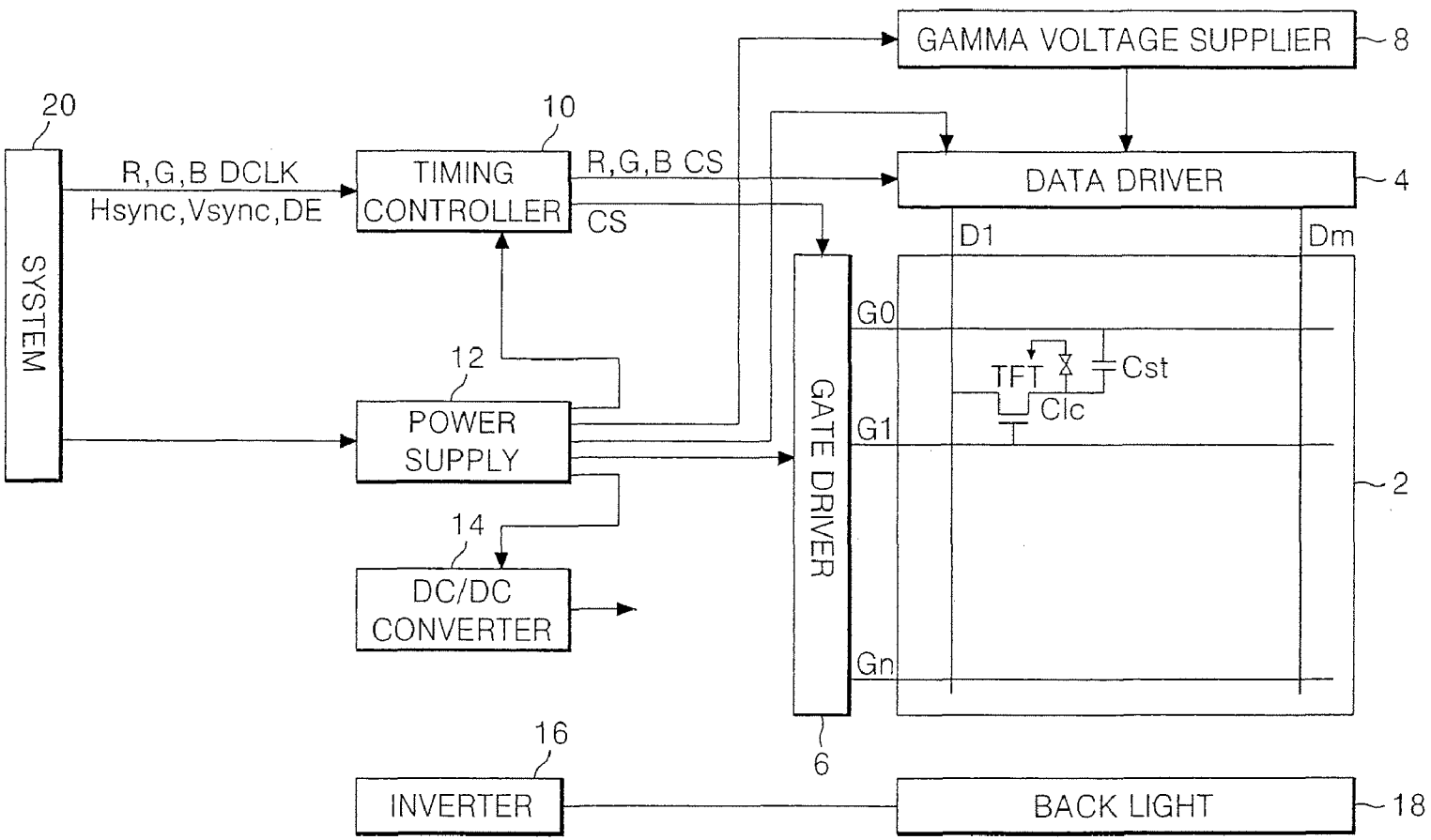
FIG. 1 RELATED ART
FIG. 1 is a schematic block diagram illustrating a driving apparatus for a liquid crystal display device according to the related art.
Figure 2:
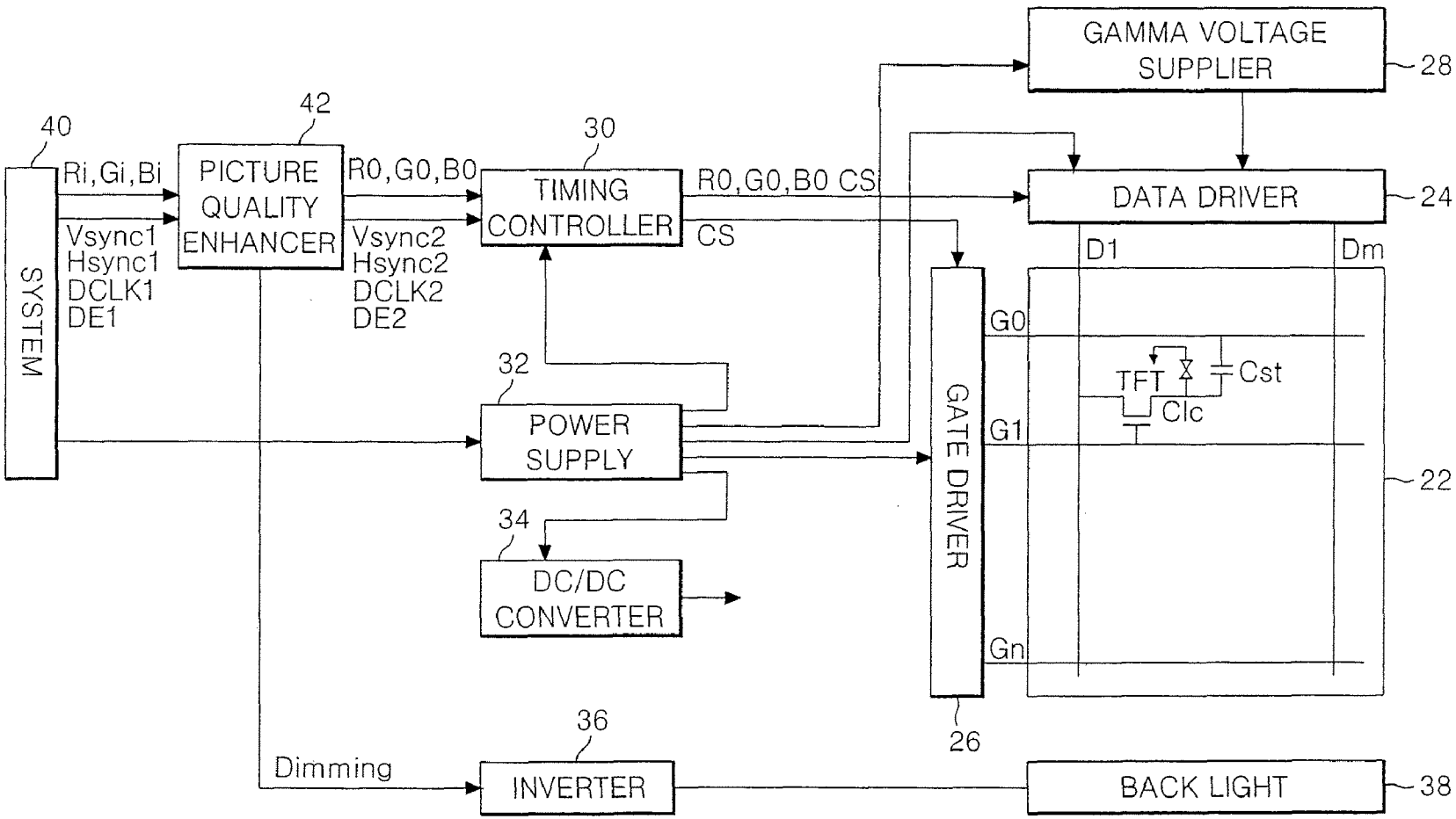
FIG. 2 is a schematic block diagram illustrating an exemplary driving apparatus for a liquid crystal display according to an embodiment of the present invention.

FIG. 2 is a schematic block diagram illustrating an exemplary driving apparatus for a liquid crystal display according to an embodiment of the present invention. In FIG. 2, an LCD driving apparatus includes a liquid crystal display panel 22 having m×n liquid crystal cells Clc at intersections between data lines D1 . . . Dm and gate lines G1 . . . Gn, a data driver 24 for applying data signals to the data lines D1 . . . Dm, a gate driver 26 for applying gate signals to the gate lines G1 . . . Gn and a dummy gate line G0, and a gamma voltage supplier 28 for supplying gamma voltages to the data driver 24, and a timing controller 30 for controlling the data driver 24 and the gate driver 26 using signals applied from a picture enhancer 42.

In addition, each of the liquid crystal cells Clc includes a thin film transistor TFT. The thin film transistor TFT applies a data signal from a respective one of the data lines D1 . . . Dm to the liquid crystal cell Clc in response to a scanning signal from a respective one of the gate lines G1 . . . Gn. Each of the liquid crystal cells Clc also includes a storage capacitor Cst. The storage capacitor Cst maintains a voltage of the liquid crystal cell Clc.

Further, the data driver 24 converts digital video data R0, G0 and B0 supplied from the timing controller 30 into analog gamma voltages, i.e., data signals, corresponding to gray level values in response to a control signal CS from the timing controller 30, and applies the analog gamma voltages to the data lines D1 . . . Dm. The gate driver 26 sequentially applies a scanning pulse to the gate lines G1 . . . Gn in response to the control signal CS from the timing controller 30, to thereby select horizontal lines of the liquid crystal display panel 22 to be supplied with the data signals.

The LCD driving apparatus also includes a system 40. The system 40 applies input video data Ri, Ri and Bi, first vertical/horizontal synchronizing signals Vsync1 and Hsync1, a first clock signal DCLK1 and a first data enable signal DE1 to the picture quality enhancer 42. Further, the system 40 controls a power supply 32. In particular, the LCD driving apparatus includes a DC/DC converter 34 for selectively boosting or dropping a source voltage inputted from the power supply 32 to generate a gamma reference voltage, a gate high voltage VGH, a gate low voltage VGL and a common voltage Vcom (not shown).

In addition, the picture quality enhancer 42 selectively emphasizes a contrast of an input data, generates a brightness control signal Dimming corresponding to the input data, and applies the brightness control signal Dimming to an inverter 36. For instance, the picture quality enhancer 42 extracts brightness components from the input video data Ri, Gi and Bi applied from the system 40, and generates the video data Ro, Go and Bo by a change in gray level values of the input video data Ri, Gi and Bi in correspondence with the extracted brightness components. In this case, the picture quality enhancer 42 generates the video data Ro, Go and Bo, such that a contrast is expanded with respect to the input video data Ri, Gi and Bi.

Further, the picture quality enhancer 42 generates a brightness control signal Dimming corresponding to the extracted brightness components. For instance, the picture quality enhancer 42 may extract a most-frequent value (i.e., a gray level value existing in one frame most frequently) or an average value (i.e., an average value of gray levels of one frame) from the brightness components, and may generate the brightness control signal Dimming based on such an extracted control value. In addition, the picture quality enhancer 42 may divide brightness of the back light corresponding to gray levels of the brightness components into at least two regions, and may generate the brightness control signal Dimming according to such regions.

Moreover, the picture quality enhancer 42 generates second vertical/horizontal synchronizing signals Vsync2 and Hsync2, a second clock signal DCLK2 and a second data enable signal DE2 based on the first vertical/horizontal synchronizing signals Vsync1 and Hsync1, the first clock signal DCLK1 and the first data enable signal DE1 for synchronizing the video data Ro, Go and Bo.

The inverter 36 drives a back light 38. In particular, the inverter 36 applies a driving voltage or a driving current for driving the back light 38 in accordance with the brightness control signal Dimming applied from the picture quality enhancer 42. The back light 38 then generates light having various degrees of brightness corresponding to the driving voltage or the driving current from the inverter 36 for the liquid crystal display panel 22.

Furthermore, the timing controller 30 generates the control signal CS for the data driver 24 and the gate driver 26 using the second vertical/horizontal synchronizing signals Vsync2 and Hsync2, the second clock signal DCLK2 and the second data enable signal DE2 inputted from the picture quality enhancer 42. Although not shown, the control signal CS for the gate driver 26 may include a gate start pulse GSP, a gate shift clock GSC and a gate output enable signal GOE, and the control signal CS for the data driver 24 may include a source start pulse SSP, a source shift clock SSC, a source output enable signal SOE and a polarity control signal POL. The timing controller 30 also may re-align the video data R, G and B supplied from the picture quality enhancer 42 before applying them to the data driver 24.

Figure 3:
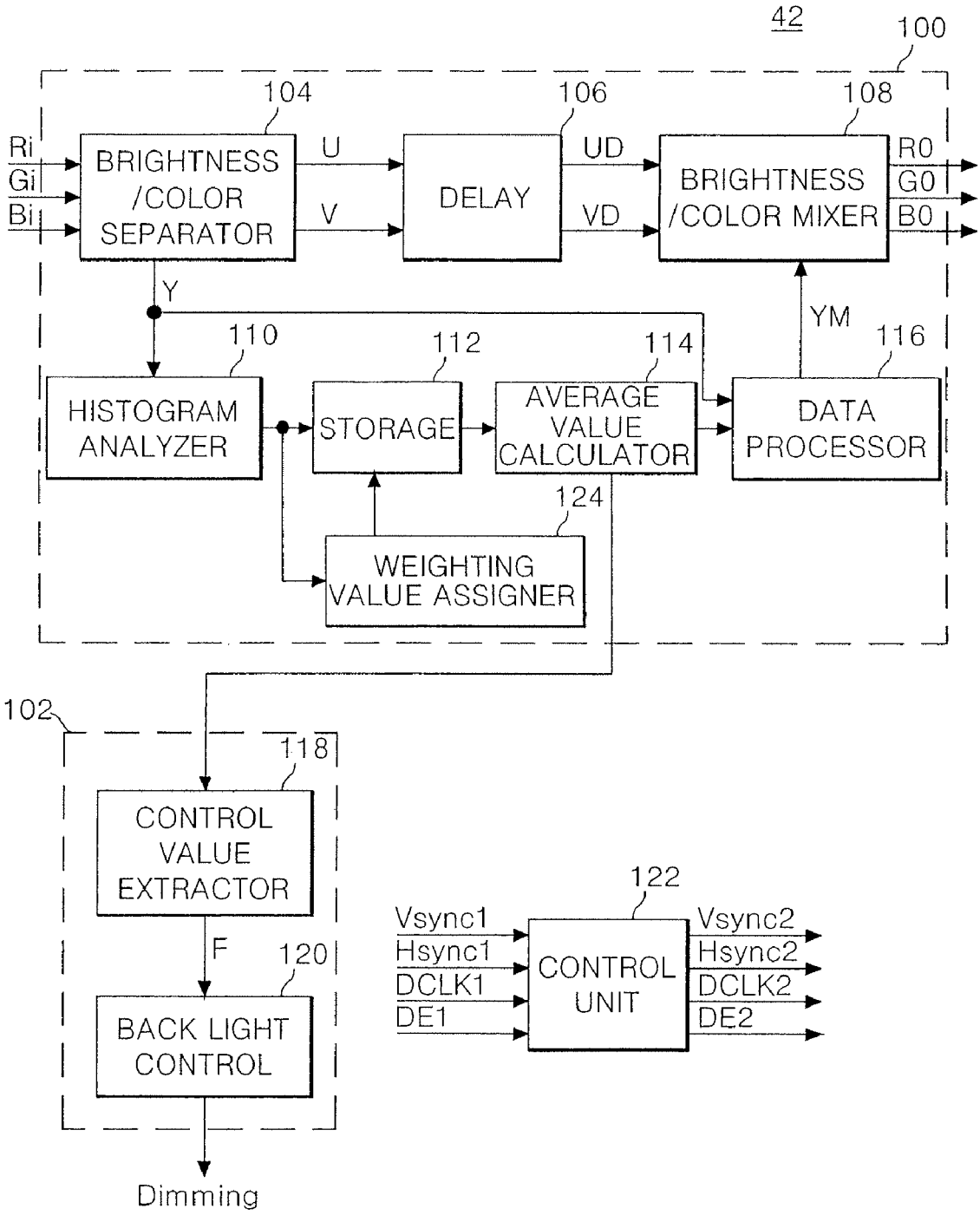
FIG. 3 is a block diagram illustrating a configuration of the picture quality enhancer shown in FIG. 2 according to an embodiment of the present invention.

FIG. 3 is a block diagram illustrating a configuration of the picture quality enhancer shown in FIG. 2 according to an embodiment of the present invention. As shown in FIG. 3, the picture quality enhancer 42 may include an image signal modulator 100 for generating the video data Ro, Go and Bo, a back light controller 102 for generating the brightness control signal Dimming, and a control unit 122 for generating the second vertical/horizontal synchronizing signals Vsync2 and Hsync2, the second clock signal DCLK2 and the second enable signal DE2.

The control unit 122 receives the first vertical/horizontal synchronizing signals Vsync1 and Hsync1, the first clock signal DCLK1 and the first data enable signal DE1 from the system 40 (shown in FIG. 2). In particular, the control unit 122 generates the second vertical/horizontal synchronizing signals Vsync2 and Hsync2, the second clock signal DCLK2 and the second data enable signal DE2 in synchronization with the video data Ro, Go and Bo, and applies the second vertical/horizontal synchronizing signals Vsync2 and Hsync2, the second clock signal DCLK2 and the second data enable signal DE2 to the timing controller 30 (shown in FIG. 2).

In addition, the image signal modulator 100 extracts brightness components Y from the input video data Ri, Gi and Bi from the system 40 (shown in FIG. 2), and generates video data Ro, Go and Bo in which a contrast is partially emphasized with the aid of the extracted brightness components Y. In particular, the image signal modulator 100 includes a brightness/color separator 104, a delay 106, a brightness/color mixer 108, a histogram analyzer 110, a storage unit 112, an average value calculator 114, a data processor 116 and a weighting value assigner 124.

The brightness/color separator 104 separates the input video data Ri, Gi and Bi into brightness components Y and chrominance components U and V. In particular, the brightness components Y and the chrominance components U and V may based obtained based on the following equations:

$$Y=0.229\times Ri+0.587\times Gi+0.114\times Bi \quad (1)$$

$$U=0.493\times(Bi-Y) \quad (2)$$

$$V=0.887\times(Ri-Y) \quad (3)$$

In the equation (1), constant values 0.229, 0.578 and 0.114 for obtaining the brightness component Y may be slightly adjusted to control a distribution of the brightness component.

In addition, the histogram analyzer 110 divides the brightness components Y into gray levels for each frame. For instance, the histogram analyzer 110 may arrange the brightness components Y for each frame to correspond to the gray levels, thereby obtaining histograms as shown in FIGS. 5A to 5D where shapes of the histograms correspond to the brightness components of the input video data Ri, Gi and Bi. In FIGS. 5A to 5D, the X-axis represents gray level values and the Y-axis represents frequency numbers of the gray levels.

The storage unit 112 stores histograms for at least two frames that are prior to the current frame. For instance, the storage unit 112 may store about ten histograms respectively for ten frames that are immediately prior to the current frame. Further, the weighting value assigner 124 assigns a weighting value to each histogram stored in the storage unit 112. In particular, the weighing value assigner 124 may assign the weighting value based on how closely the histogram relates the current frame in time. For example, the histogram for the frame that is immediately prior to the current frame may be assigned to a higher weighting value than the histogram for the frame that is two time-periods prior to the current frame.

For instance, the weighting value assigner 124 may assign a weighting value to a histogram stored in the storage unit 112 based on the following equation:

$$H_gran^5\times i+H_gran^4\times 2i+H_gran^3\times 3i+H_gran^2\times 4i+H_gran^1\times 5i \quad (4)$$

In the equation (4), 'H_gran' of "$H_gran^X$" represents a histogram, and "X" denotes a time position of frame. In particular, a larger value of "X" means a histogram is farther from the current frame while a smaller value of "X" means a histogram closer to the current frame. A higher weighting value is assigned to a frame closer to the current frame because it is more likely that a frame closer to the current frame has an image analogous to the currently displayed image, thereby producing an average histogram having a pattern analogous to an image displayed at the current frame from the average value calculator 114.

Then, the average value calculator 114 calculates an average of the histograms stored in the storage unit 112. For instance, each gray level value having been stored in the storage unit 112 as shown in FIGS. 5A to 5D is converted into an average value, thereby producing a single histogram, i.e., an average histogram. Since a frame closer to the current frame in time is assigned with a higher weighting value by the weighting value assigner 124, such a frame affects the average histogram more.

Further, the data processor 116 generates modulated brightness components YM having an emphasized contrast using the average histogram calculated by the average value calculator 114. In particular, various schemes may be used as a method of generating the modulated brightness components YM having an emphasized contrast from the data processor 116. For example, the data processor 116 may employ schemes disclosed in Korean Patent Applications Nos. 2003-036289, 2003-040127, 2003-041127, 2003-80177, 2003-81171, 2003-81172, 2003-81173 and 2003-81175 by the applicants or other schemes to expand the contrast.

The delay 106 delays chrominance components U and V until the modulated brightness components YM are produced by the data processor 116. The delay 106 then applies the delayed chrominance components VD and UD to the brightness/color mixer 108 in synchronization with the modulated brightness components YM. The brightness/color mixer 108 then generates the video data Ro, Go and Bo based on the modulated brightness components YM and the delayed chrominance components UD and VD. For example, the video data Ro, Go and Bo may be obtained based on the following equations:

$$R=Y+0.000\times U+1.140\times V \quad (5)$$

$$G=Y-0.396\times U-0.581\times V \quad (6)$$

$$B=Y+2.029\times U+0.000\times V \quad (7)$$

As a result, the video data Ro, Go and Bo have more expanded contrast than the input video data Ri, Gi and Bi since the video data Ro, Go and Bo are produced based on the modulated brightness components YM having an expanded contrast. Then, the video data Ro, Go and Bo are applied to the timing controller 30 (shown in FIG. 3).

In addition, the back light controller 102 extracts a control value from the average value calculator 114, and generates the brightness control signal Dimming based on the extracted control value. In particular, a value of the control value may set to allow the back light 38 (shown in FIG. 3) to generate light having various degrees of brightness. For instance, a most-frequent value (i.e., a gray level value existing most frequently in a histogram for one frame) or an average value (i.e., an average value of gray levels of a histogram for one frame) may be used as the control value.

In particular, the back light controller 102 includes a control value extractor 118 and a back light control 120. The control value extractor 118 extracts a control value F from the average histogram calculated by the average value calculator 114. Then, the back light control 120 generates the brightness control signal Dimming based on the control value F and applies the brightness control signal Dimming to the inverter 36 (shown in FIG. 2).

Figure 4:
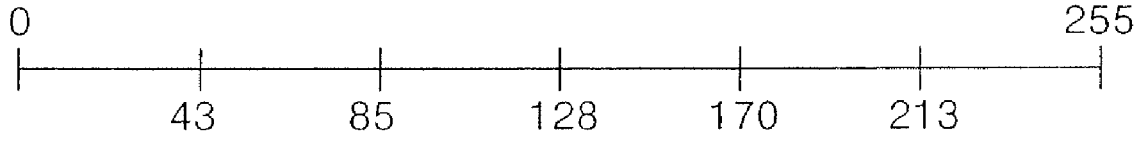
FIG. 4 depicts a brightness area for controlling brightness at the back light controller shown in FIG. 3.
Figure 5A:
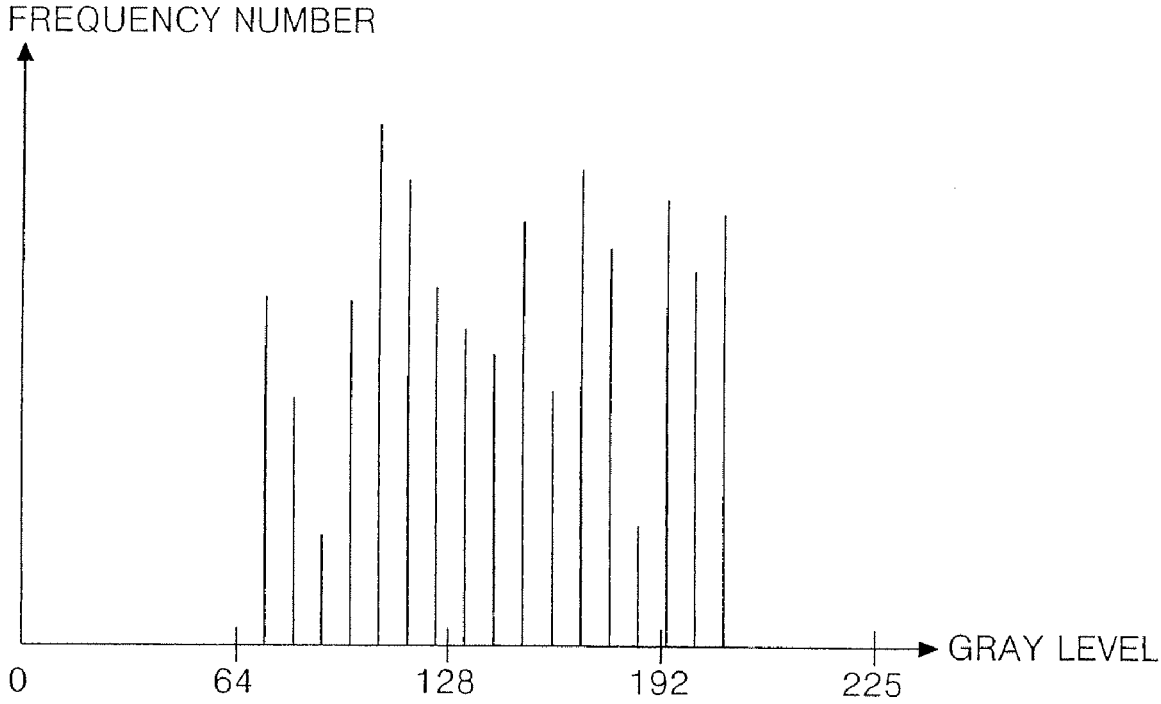
FIGS. 5A to 5D are graphs showing histograms analyzed by the histogram analyzer shown in FIG. 3.
Figure 5B:
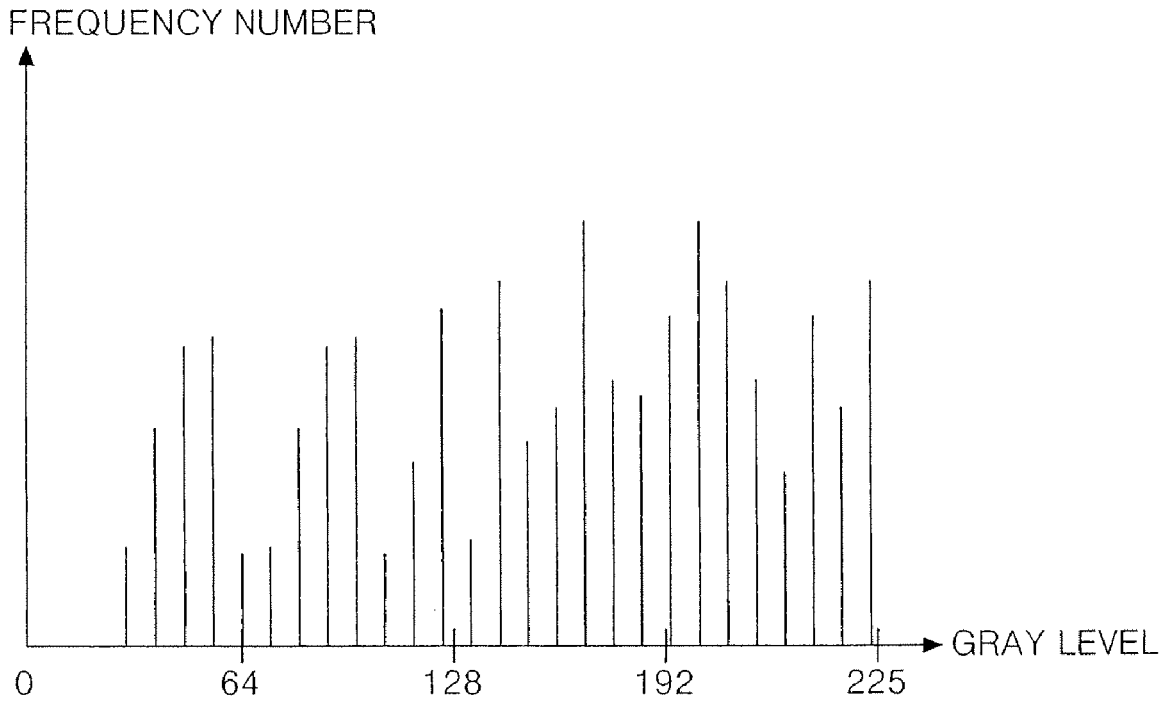
Figure 5C:
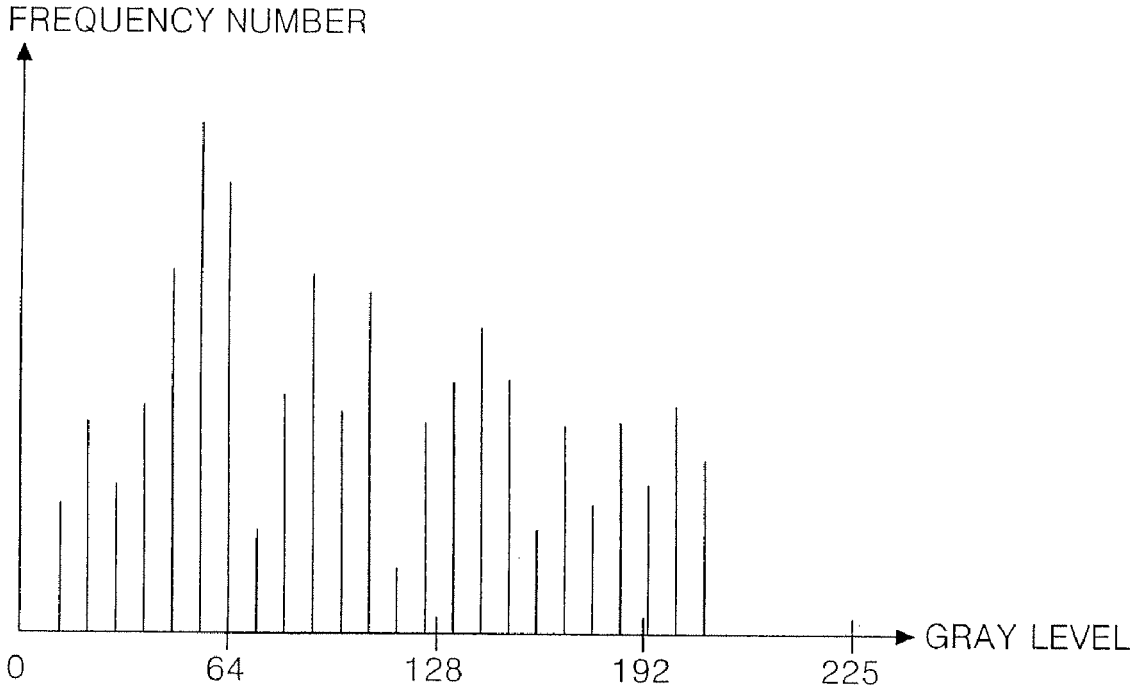
Figure 5D:
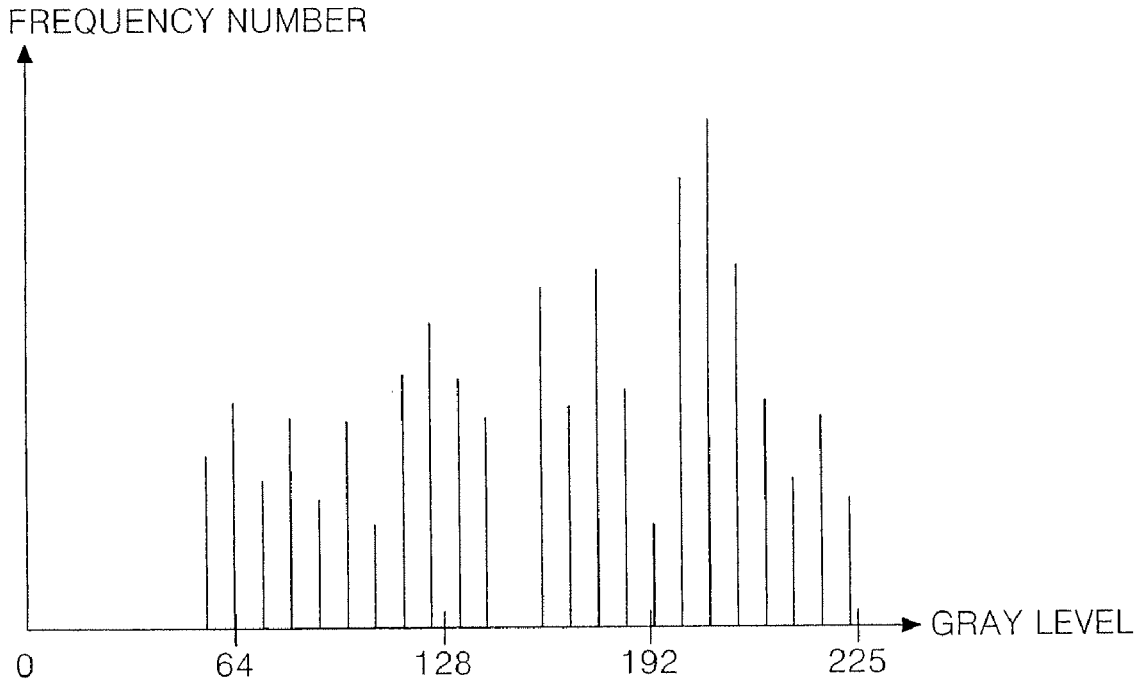

FIG. 4 depicts a brightness area for controlling brightness at the back light controller shown in FIG. 3. As shown in FIG. 4, the back light control 120 (shown in FIG. 3) divides gray levels of the brightness components Y into a plurality of areas, thereby controlling the back light 38 (shown in FIG. 2) to supply light of a different brightness to each of these areas. For instance, the back light control 120 (shown in FIG. 3) may generate the brightness control signal Dimming such that light corresponding to a gray level of 130 is produced when the control value F is 130. Further, the back light control 120 (shown in FIG. 3) may generate the brightness control signal Dimming such that light having one level lower value than 136 is produced when the control value F is 100.

Accordingly, the driving apparatus according to an embodiment of the present embodiment generates an average histogram based on histograms for at least two frames and generates the video data Ro, Go and Bo having an emphasized contrast using the average histogram, thereby driving the liquid crystal display panel 22 to display more vivid image than the related art. Furthermore, the driving apparatus according to an embodiment of the present embodiment extracts a control value from the average histogram and controls the back light 38 using the extracted control value to generate light having various degrees of brightness, to thereby drive the liquid crystal display panel 22 to display more dynamic and vivid image than the related art. Moreover, the driving apparatus according to an embodiment of the present embodiment controls brightness based on a plurality of frames, thereby minimizing defects caused by noises and preventing sudden changes in brightness.

However, the picture quality enhancer 42 shown in FIG. 3 may change brightness of the back light 38 even when a still image is displayed. In particular, when the liquid crystal display panel 22 is used as a monitor for a personal computer or as a TV, the liquid crystal display panel 22 may need to display various still images in addition to moving images. To ensure brightness of the liquid crystal display panel 22 being stable when displaying a still image, the picture quality enhancer 42 may have the configuration shown in FIG. 6.

Figure 6:
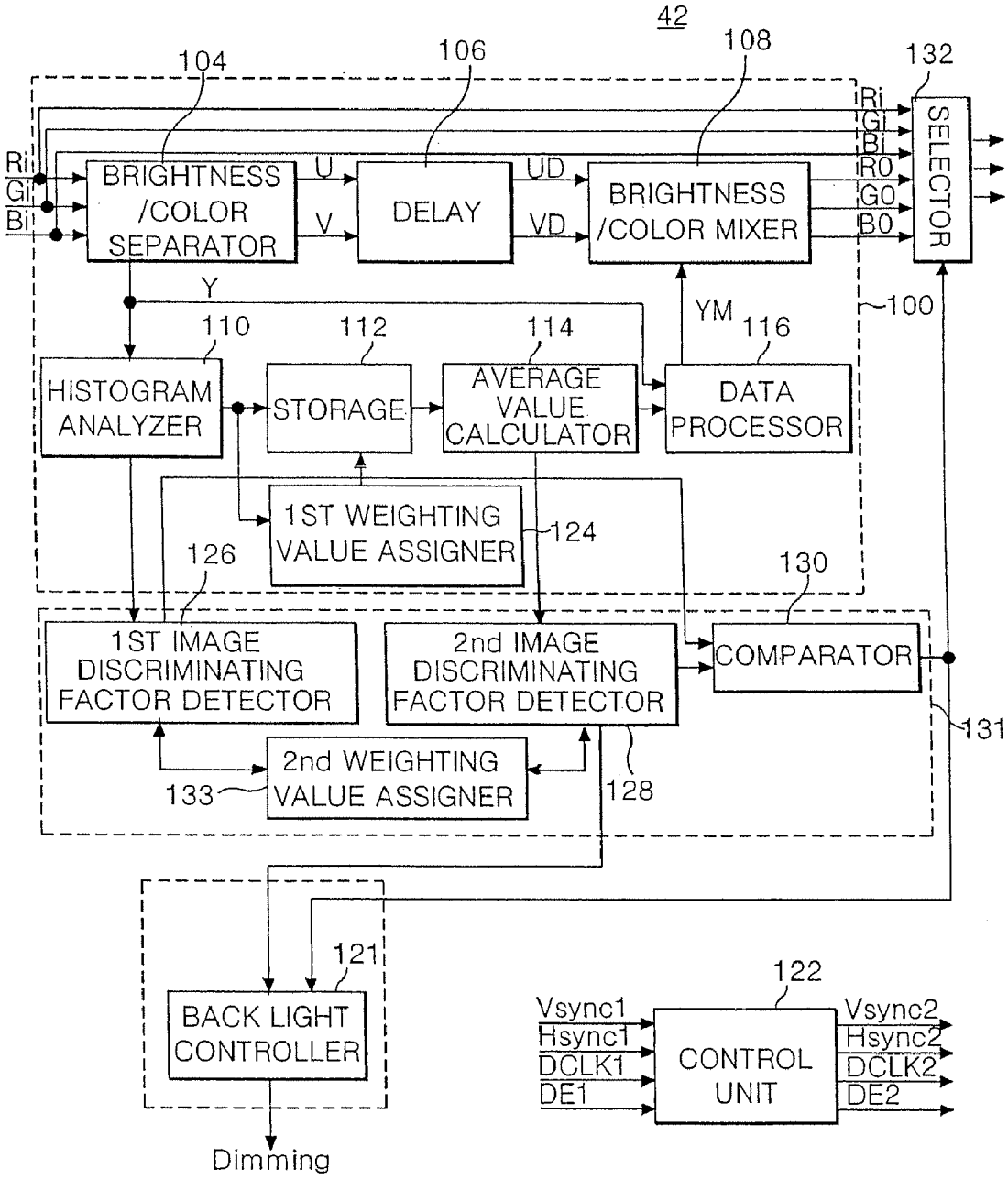
FIG. 6 is a block diagram illustrating a configuration of the picture quality enhancer shown in FIG. 2 according to another embodiment of the present invention.

FIG. 6 is a block diagram illustrating a configuration of the picture quality enhancer shown in FIG. 2 according to another embodiment of the present invention. As shown in FIG. 6, the picture quality enhancer 42 may include an image signal modulator 100 for generating the video data Ro, Go and Bo, a back light controller 121 for generating the brightness control signal Dimming, a control unit 122 for generating the second vertical/horizontal synchronizing signals Vsync2 and Hsync2, the second clock signal DCLK2 and the second enable signal DE2, an image discriminator 131 for discriminating a still image or a moving image, and a selector 132 for selectively applying the input video data Ri, Gi and Bi or the video data Ro, Go and Bo to the timing controller 30 (shown in FIG. 2).

The control unit 122 receives the first vertical/horizontal synchronizing signals Vsync1 and Hsync1, the first clock signal DCLK1 and the first data enable signal DE1 from the system 40 (shown in FIG. 2). In particular, the control unit 122 generates the second vertical/horizontal synchronizing signals Vsync2 and Hsync2, the second clock signal DCLK2 and the second data enable signal DE2 in synchronization with the input video data Ri, Gi and Bi or the video data Ro, Go and Bo. The control unit 122 then applies the second vertical/horizontal synchronizing signals Vsync2 and Hsync2, the second clock signal DCLK2 and the second data enable signal DE2 to the timing controller 30 (shown in FIG. 2).

In addition, the image signal modulator 100 extracts brightness components Y from the input video data Ri, Gi and Bi from the system 40 (shown in FIG. 2), and generates video data Ro, Go and Bo in which a contrast is partially emphasized with the aid of the extracted brightness components Y. In particular, the image signal modulator 100 includes a brightness/color separator 104, a delay 106, a brightness/color mixer 108, a histogram analyzer 110, a storage unit 112, an average value calculator 114, a data processor 116 and a first weighting value assigner 124.

The brightness/color separator 104 separates the input video data Ri, Gi and Bi into brightness components Y and chrominance components U and V. In particular, the brightness components Y and the chrominance components U and V may based obtained based on the equations (1) to (3). Then, the histogram analyzer 110 divides the brightness components Y into gray levels for each frame. For instance, the histogram analyzer 110 may arrange the brightness components Y for each frame to correspond to the gray levels, thereby obtaining histograms as shown in FIGS. 5A to 5D where shapes of the histograms correspond to the brightness components of the input video data Ri, Gi and Bi.

Further, the storage unit 112 stores histograms for at least two frames that are prior to the current frame. The first weighting value assigner 124 further assigns a weighting value to each histogram stored in the storage unit 112. In particular, the first weighing value assigner 124 may assign the weighting value based on how closely the histogram relates the current frame in time.

Then, the average value calculator 114 calculates an average of the histograms stored in the storage unit 112. For instance, each gray level value having been stored in the storage unit 112 as shown in FIGS. 5A to 5D is converted into an average value, thereby producing a single histogram, i.e., an average histogram. Since a frame closer to the current frame in time is assigned with a higher weighting value by the first weighting value assigner 124, such a frame affects the average histogram more.

Further, the data processor 116 generates modulated brightness components YM having an emphasized contrast using the average histogram calculated by the average value calculator 114. The delay 106 delays chrominance components U and V until the modulated brightness components YM are produced by the data processor 116. The delay 106 then applies the delayed chrominance components VD and UD to the brightness/color mixer 108 in synchronization with the modulated brightness components YM.

The brightness/color mixer 108 then generates the video data Ro, Go and Bo based on the modulated brightness components YM and the delayed chrominance components UD and VD. For example, the video data Ro, Go and Bo may be obtained based on the equations (5) to (7). Further, the video data Ro, Go and Bo are applied to the selector 132.

Moreover, the image discriminator 131 discriminates whether an image to be displayed on the liquid crystal display panel 22 is a moving image or a still image. The image discriminator 131 may use the histograms analyzed by the histogram analyzer 110 and the average histogram generated from the average value calculator 114. In particular, the image discriminator 131 includes a first image discriminating factor detector 126, a second discriminating factor detector 128, a comparator 130 and a second weighting value assigner 133.

The first image discriminating factor detector 126 detects first image discriminating factors from the histograms analyzed by the histogram analyzer 110. The first image discriminating factors may include an average value, a most-frequent value, a center value, an intermediate value, a maximum value, a minimum value and a range value of the histograms.

The average value refers to an average value of histogram gray levels (i.e., an average value of gray levels in one frame). The most-frequent value refers to a gray level value having the highest frequency number in one frame. The center value refers to a value positioned at the center portion when gray level values of a frame arranged in a histogram in accordance with the frequency number. For example, when gray level values in the histograms in which a gray level of '1' appears three times; a gray level of '2' appears once; a gray level of '3' appears twice; and a gray level of '4' appears once are listed in accordance with the frequency number, gray level values appear as "1112334". Since a value positioned at the center portion is '2', the center value would be '2'. The intermediate value refers to intermediate gray level values appearing between the maximum gray level value and the minimum gray level value. The maximum value refers to the maximum gray level value appearing at the histograms. The minimum value refers to the minimum gray level value appearing at the histograms. The range value is a range value of gray level values appearing at the histograms, and is obtained by a subtraction of the minimum gray level value from the maximum gray level value.

After the first image discriminating factors were detected by the first image discriminating factor detector 126, the second weighting value assigner 133 assigns a predetermined weighting value for each discriminating factor. In particular, the second weighting value assigner 133 assigns a high weighting value for a discriminating factor that provides more reliable characteristics of an image. For instance, the second weighting value assigner 133 may assign the highest weighting value for the average value and the most-frequent value capable of indicating a characteristic of an image very well while assigning a middle weighting value for the range value. Further, the second weighting value assigner 133 may assign low weighting values for the maximum value, the minimum value, the center value and the intermediate value.

Then, after weighting values are assigned to the first image discriminating factors by the second weighting value assigner 133, the first image discriminating factor detector 126 converts the discriminating factors assigned by the weighting values into a single value (hereinafter, referred to as "first discriminating factor") and then applies it to the comparator 130. Various methods may be employed to convert the first image discriminating factors into the first discriminating factor. For instance, each value may be added to each other to generate a sum as the first discriminating factor or such a sum may further be divided by the number of first image discriminating factors to generate a resultant value as the first discriminating factor.

In addition, the second image discriminating factor detector 128 detects second image discriminating factors from the average histogram analyzed by the average value calculator 114. The second image discriminating factors may include the average value, the most-frequent value, the center value, the intermediate value, the maximum value, the minimum value and the range value of the average histogram. After the second image discriminating factors are detected by the second image discriminating factor detector 128, the second weighting value assigner 133 assigns a predetermined weighting value for each discriminating factor. In particular, the second weighting value assigner 133 may assign the weighting values to the second image discriminating factors in a similar manner as how the weighting values are assigned to the first image discriminating factors.

After weighting values were assigned to the second image discriminating factors by the second weighting value assigner 133, the second image discriminating factor detector 128 converts discriminating factors assigned by the weighting values into a single value (hereinafter, referred to as "second discriminating factor"), and applies it to the comparator 130. In particular, the second discriminating factor may be calculated in the same manner as the first discriminating factor.

Moreover, the comparator 130 detects an analogy between the first discriminating factor and the second discriminating factor. For instance, the comparator 130 discriminates a current display image as a still picture when the first and second discriminating factors fall within a predetermined range while discriminating the current display image as a moving picture otherwise. In particular, the predetermined range may be variously set in accordance with a size (inch) and a resolution of the liquid crystal display panel 22. Specifically, the predetermined range may be experimentally determined in consideration of the size (inch) and the resolution of the liquid crystal display panel 22.

Further, the comparator 130 applies a first control signal to the selector 132 and to the back light controller 121 when the current display image is discriminated as a still picture, and applies a second control signal to the selector 132 and to the back light controller 121 when the current display image is discriminated as a moving picture.

Thus, the selector 132 applies the input data Ri, Gi and Bi to the timing controller 30 (shown in FIG. 2) when the first control signal is applied thereto, and applies the video data Ro, Go and Bo to the timing controller 30 (shown in FIG. 2) when the second control signal is applied thereto. In addition, the back light controller 121 generates the brightness control signal Dimming based on the second discriminating factor when the second control signal is applied. Further, the back light controller 121 generates the brightness control signal Dimming based on a predetermined brightness of light, e.g., light having the same brightness as the related art, when the first control signal is applied.

As a result, when the current display image is discriminated as a still image, the brightness control signal Dimming controls the back light 38 (shown in FIG. 2) to supply light of the same brightness to the liquid crystal display pane 22 (shown in FIG. 2). When the current display image is discriminated as a moving image, the brightness control signal Dimming controls the back light (shown in FIG. 2) to supply light of various degrees of brightness to the liquid crystal display panel 22.

Accordingly, the driving apparatus according to an embodiment of the present embodiment selectively outputs the input video data Ri, Gi and Bi or the video data Ro, Go and Bo having an emphasized contrast using the average histogram, thereby driving the liquid crystal display panel 22 to display stable still images or more vivid moving images.

Figure 7A:
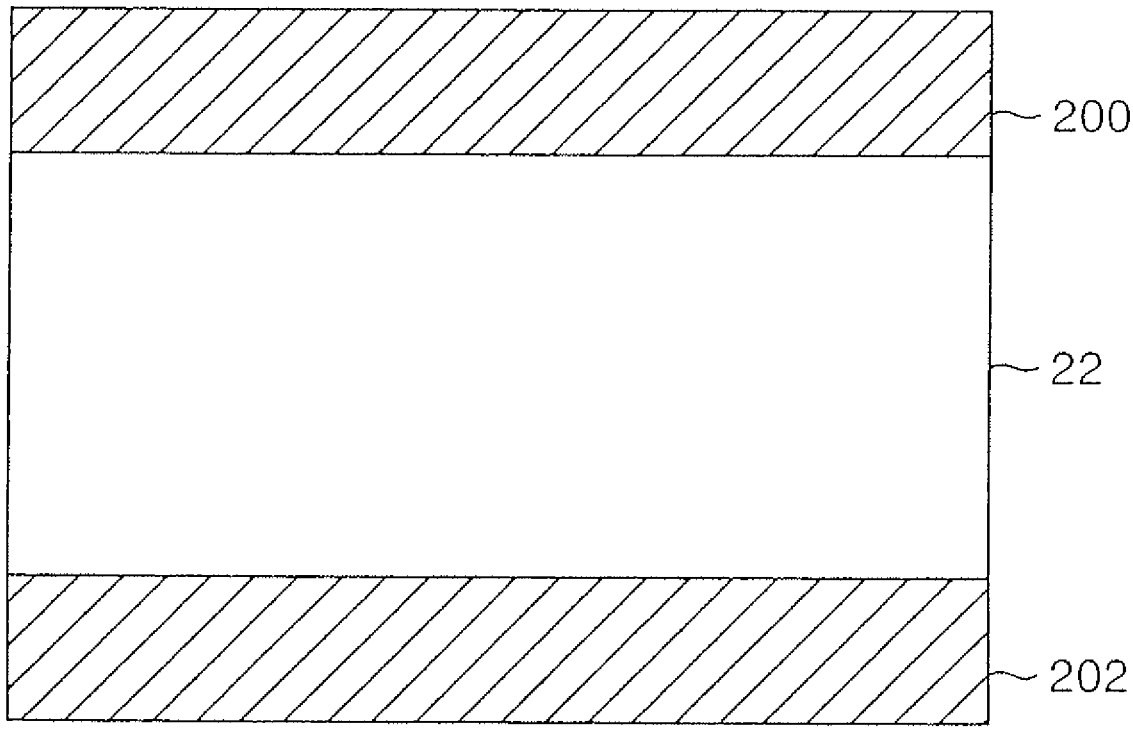
FIGS. 7A and 7B depict an area of the liquid crystal display panel.
Figure 7B:
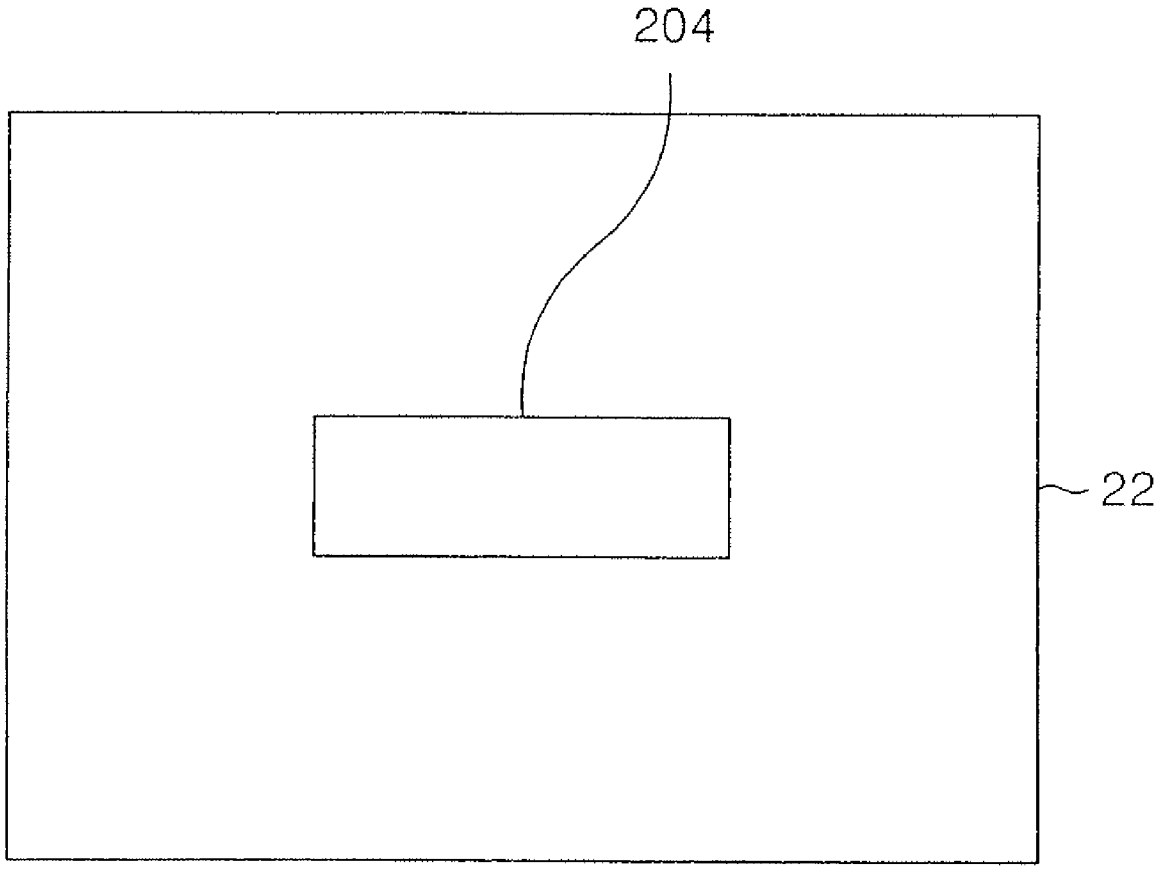

FIGS. 7A and 7B depict an area of the liquid crystal display panel. The picture quality enhancer 42 shown in FIG. 6 analyzes brightness at the entire area of the liquid crystal display panel 22, as shown in FIG. 7A. However, a portion of the liquid crystal display panel 22 may display a still image while another portion of the liquid crystal display panel 22 may display a moving image. For example, when a DVD image is displayed, a still picture may be displayed at the upper portion 200 and the lower portion 202 of the liquid crystal display panel 22, while a moving image may be displayed at the remaining display portion of the liquid crystal display panel 22. Thus, when brightness at the entire area of the liquid crystal display panel 22 is analyzed, the analysis may not be completely accurate.

In order to ensure the accuracy of the brightness analysis, an analysis may be limited to a portion 204 of the liquid crystal display panel 22, as shown in FIG. 7B. Further, the picture quality enhancer 42 may have the configuration shown in FIG. 8 to focus the brightness analysis to the portion 204.

Figure 8:
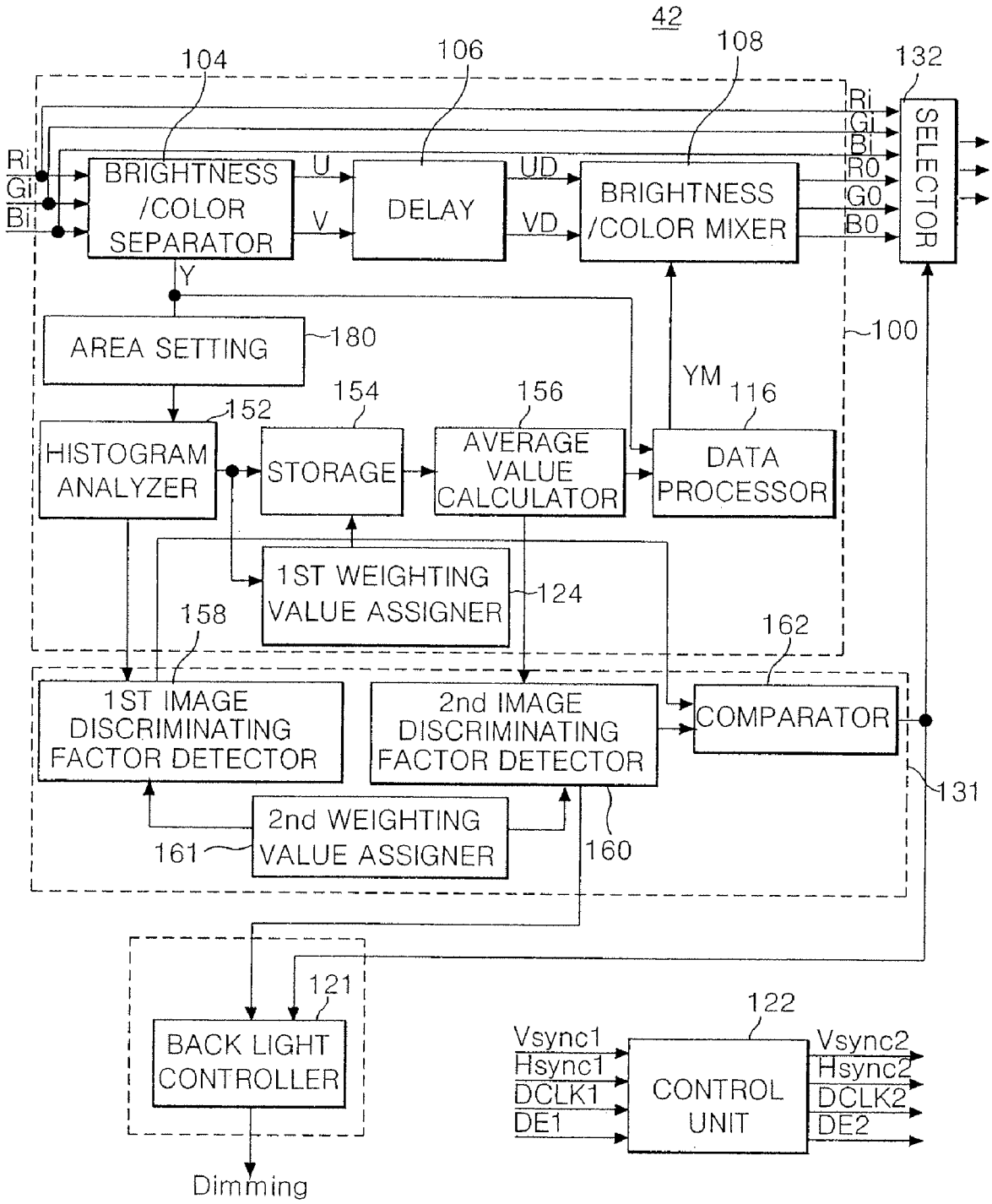
FIG. 8 is a block diagram illustrating a configuration of the picture quality enhancer shown in FIG. 2 according to another embodiment of the present invention.

FIG. 8 is a block diagram illustrating a configuration of the picture quality enhancer shown in FIG. 2 according to another embodiment of the present invention. As shown in FIG. 8, the picture quality enhancer 42 may include an image signal modulator 100 for generating the video data Ro, Go and Bo, a back light controller 121 for generating the brightness control signal Dimming, a control unit 122 for generating the second vertical/horizontal synchronizing signals Vsync2 and Hsync2, the second clock signal DCLK2 and the second enable signal DE2, an image discriminator 131 for discriminating a still image or a moving image, and a selector 132 for selectively applying the input video data Ri, Gi and Bi or the video data Ro, Go and Bo to the timing controller 30 (shown in FIG. 2).

The control unit 122 receives the first vertical/horizontal synchronizing signals Vsync1 and Hsync1, the first clock signal DCLK1 and the first data enable signal DE1 from the system 40 (shown in FIG. 2). In particular, the control unit 122 generates the second vertical/horizontal synchronizing signals Vsync2 and Hsync2, the second clock signal DCLK2 and the second data enable signal DE2 in synchronization with the input video data Ri, Gi and Bi or the video data Ro, Go and Bo. The control unit 122 then applies the second vertical/horizontal synchronizing signals Vsync2 and Hsync2, the second clock signal DCLK2 and the second data enable signal DE2 to the timing controller 30 (shown in FIG. 2).

In addition, the image signal modulator 100 extracts brightness components Y from the input video data Ri, Gi and Bi from the system 40 (shown in FIG. 2), and generates video data Ro, Go and Bo in which a contrast is partially emphasized with the aid of the extracted brightness components Y. In particular, the image signal modulator 100 includes a brightness/color separator 104, a delay 106, a brightness/color mixer 108, an area setting unit 180, a histogram analyzer 152, a storage unit 154, an average value calculator 156, a data processor 116 and a first weighting value assigner 124.

The brightness/color separator 104 separates the input video data Ri, Gi and Bi into brightness components Y and chrominance components U and V. In particular, the brightness components Y and the chrominance components U and V may based obtained based on the equations (1) to (3). Then, the area setting unit 180 extracts brightness components YA of a data supplied to a certain area of the liquid crystal display panel 22. For instance, the area setting unit 180 may extract brightness components YA of a data to be supplied to the center portion 204 of the liquid crystal display panel 22 (as shown in FIG. 7B). Thus, brightness components of a data supplied to the upper portion 200 and the lower portion 202 of the liquid crystal display panel 22 (as shown in FIG. 7A) are not included in the brightness analysis.

Further, the histogram analyzer 152 divides the extracted brightness components YA into gray levels for each frame. For instance, the histogram analyzer 152 may arrange the extracted brightness components YA for each frame to correspond to the gray levels, thereby obtaining histograms as shown in FIGS. 5A to 5D where shapes of the histograms correspond to the brightness components of the input video data Ri, Gi and Bi.

In addition, the storage unit 154 stores histograms for at least two frames that are prior to the current frame. The first weighting value assigner 124 further assigns a weighting value to each histogram stored in the storage unit 154. In particular, the first weighing value assigner 124 may assign the weighting value based on how closely the histogram relates the current frame in time.

Then, the average value calculator 156 calculates an average of the histograms stored in the storage unit 154. For instance, each gray level value having been stored in the storage unit 154 as shown in FIGS. 5A to 5D is converted into an average value, thereby producing a single histogram, i.e., an average histogram. Since a frame closer to the current frame in time is assigned with a higher weighting value by the first weighting value assigner 124, such a frame affects the average histogram more.

Further, the data processor 116 generates modulated brightness components YM having an emphasized contrast using the average histogram calculated by the average value calculator 156. The delay 106 delays chrominance components U and V until the modulated brightness components YM are produced by the data processor 116. The delay 106 then applies the delayed chrominance components VD and UD to the brightness/color mixer 108 in synchronization with the modulated brightness components YM.

The brightness/color mixer 108 then generates the video data Ro, Go and Bo based on the modulated brightness components YM and the delayed chrominance components UD and VD. For example, the video data Ro, Go and Bo may be obtained based on the equations (5) to (7). Further, the video data Ro, Go and Bo are applied to the selector 132.

Moreover, the image discriminator 131 discriminates whether an image to be displayed on the liquid crystal display panel 22 is a moving image or a still image. The image discriminator 131 may use the histograms analyzed by the histogram analyzer 152 and the average histogram generated from the average value calculator 156. In particular, the image discriminator 131 includes a first image discriminating factor detector 158, a second discriminating factor detector 160, a comparator 162 and a second weighting value assigner 161.

The first image discriminating factor detector 158 detects first image discriminating factors from the histograms analyzed by the histogram analyzer 152. The first image discriminating factors may include an average value, a most-frequent value, a center value, an intermediate value, a maximum value, a minimum value and a range value of the histograms.

After the first image discriminating factors were detected by the first image discriminating factor detector 158, the second weighting value assigner 161 assigns a predetermined weighting value for each discriminating factor. For instance, the second weighting value assigner 161 may assign the highest weighting value for the average value and the most-frequent value capable of indicating a characteristic of an image very well while assigning a middle weighting value for the range value. Further, the second weighting value assigner 161 may assign low weighting values for the maximum value, the minimum value, the center value and the intermediate value.

Then, after weighting values are assigned to the first image discriminating factors by the second weighting value assigner 161, the first image discriminating factor detector 158 converts the discriminating factors assigned by the weighting values into a single value (hereinafter, referred to as "first discriminating factor") and then applies it to the comparator 162. Various methods may be employed to convert the first image discriminating factors into the first discriminating factor. For instance, each value may be added to each other to generate a sum as the first discriminating factor. Alternatively, the first discriminating factor may be produced by dividing the summed discriminating factors by a predetermined value.

In addition, the second image discriminating factor detector 160 detects second image discriminating factors from the average histogram analyzed by the average value calculator 156. The second image discriminating factors may include the average value, the most-frequent value, the center value, the intermediate value, the maximum value, the minimum value and the range value of the average histogram. After the second image discriminating factors are detected by the second image discriminating factor detector 160, the second weighting value assigner 161 assigns a predetermined weighting value for each discriminating factor. In particular, the second weighting value assigner 161 may assign the weighting values to the second image discriminating factors in a similar manner as how the weighting values are assigned to the first image discriminating factors.

After weighting values were assigned to the second image discriminating factors by the second weighting value assigner 161, the second image discriminating factor detector 160 converts discriminating factors assigned by the weighting values into a single value (hereinafter, referred to as "second discriminating factor"), and applies it to the comparator 162. In particular, the second discriminating factor may be calculated in the same manner as the first discriminating factor.

Moreover, the comparator 162 detects an analogy between the first discriminating factor and the second discriminating factor. For instance, the comparator 162 discriminates a current display image as a still picture when the first and second discriminating factors fall within a predetermined range while discriminating the current display image as a moving picture otherwise. In particular, the predetermined range may be experimentally determined in consideration of the size (inch) and the resolution of the liquid crystal display panel 22.

Further, the comparator 162 applies a first control signal to the selector 132 and to the back light controller 121 when the current display image is discriminated as a still picture, and applies a second control signal to the selector 132 and to the back light controller 121 when the current display image is discriminated as a moving picture.

Thus, the selector 132 applies the input data Ri, Gi and Bi to the timing controller 30 (shown in FIG. 2) when the first control signal is applied thereto, and applies the video data Ro, Go and Bo to the timing controller 30 (shown in FIG. 2) when the second control signal is applied thereto. In addition, the back light controller 121 generates the brightness control signal Dimming based on the second discriminating factor when the second control signal is applied. Further, the back light controller 121 generates the brightness control signal Dimming based on a predetermined brightness of light, e.g., light having the same brightness as the related art, when the first control signal is applied.

As a result, when the current display image is discriminated as a still image, the brightness control signal Dimming controls the back light 38 (shown in FIG. 2) to supply light of the same brightness to the liquid crystal display pane 22 (shown in FIG. 2), thereby preventing a change of brightness in the course of displaying the still picture. When the current display image is discriminated as a moving image, the brightness control signal Dimming controls the back light (shown in FIG. 2) to supply light of various degrees of brightness to the liquid crystal display panel 22.

Accordingly, the driving apparatus according to an embodiment of the present embodiment generates histograms using only brightness components at a predetermined display portion, e.g., a center portion 204, of the liquid crystal display panel 22, thereby more accurately discriminating a still image or a moving image and better controlling display brightness of the liquid crystal display panel 22.

Further, in the driving apparatus according to an embodiment of the present invention, the brightness components are extracted from the first data and the second data having an emphasized contrast is generated based on the extracted brightness components, thereby displaying a vivid image. Furthermore, brightness of the back light is controlled with the aid of the brightness components extracted from the first data, thereby displaying a vivid image.

Also, in the driving apparatus according to an embodiment of the present invention, the back light is controlled and the first data is applied to the timing controller such that a certain brightness of light can be supplied when it is determined that a still picture is displayed on the liquid crystal display panel, thereby preventing a change of brightness. Moreover, the histograms are generated with the aid of the brightness components extracted from the center area of the liquid crystal display panel, thereby displaying a vivid moving image.

It will be apparent to those skilled in the art that various modifications and variations can be made in the method and apparatus for driving liquid crystal display device of the present invention without departing from the spirit or scope of the invention. Thus, it is intended that the present invention covers the modifications and variations of this invention provided they come within the scope of the appended claims and their equivalents.

What is claimed is:

1. A method of driving a liquid crystal display device, comprising:

extracting brightness components of a portion of the first data for a current frame;

arranging the brightness components for the current frame into a brightness histogram;

retrieving brightness histograms for at least two frames prior to the current frame to generate an average histogram;

generating second data for the current frame based on the average histogram;

comparing the histogram for the current frame with the average histogram to determine whether an image at the current frame is a moving image or a still image; and driving the liquid crystal display device in accordance with one of the first data and the second data based on the comparison result, wherein the step of generating the average histogram includes:

storing the histograms for at least two frames that are immediately prior to the current frame;

assigning weighting values to the stored histograms; and converting the histograms assigned with the weighting values into average values to produce the average histogram.

2. The method according to claim 1, wherein the portion of the first data corresponds to image data for a center display area of a liquid crystal display panel.

3. The method according to claim 1, wherein a higher value of the weighting values is assigned to the histogram for the frame closer to the current frame.

4. The method according to claim 1, wherein the step of comparing the histograms includes:

extracting a first image discriminating factor from the histogram for the current frame;

extracting a second image discriminating factor from the average histogram; and comparing the first image discriminating factor with the second image discriminating factor to discriminate whether an image at the current frame is a moving image or a still image.

5. The method according to claim 4, wherein the first image discriminating factor includes an average gray level value of the histogram for the current frame, a most-frequent gray level value of the histogram for the current frame, a center value positioned at the center when the gray level values of the histogram for the current frame are arranged in accordance with the frequency number, a maximum gray level value of the histogram for the current frame, a minimum gray level value of the histogram for the current frame, a gray level range value of the histogram for the current frame, and an intermediate gray level value of the histogram for the current frame.

6. The method according to claim 5, further comprising the steps of:

assigning a high weighting value for the average gray level value and the most-frequent gray level value;

assigning a middle weighting value for the gray level range value;

assigning a low weighting value for the minimum gray level value, the maximum gray level value, the center value and the intermediate gray level value; and generating the first discriminating factor based on the weighted average gray level value, the weighted most-frequent gray level value, the weighted gray level range value, the weighted minimum gray level value, the weighted maximum gray level value, the weighted center value and the weighted intermediate gray level value.

7. The method according to claim 4, wherein the second image discriminating factor includes an average gray level value of the average histogram, a most-frequent gray level value of the average histogram, a center value positioned at the center when the gray level values of the average histogram are arranged in accordance with the frequency number, a maximum gray level value of the average histogram, a minimum gray level value of the average histogram, a gray level range value of the average histogram, and an intermediate gray level value of the average histogram.

8. The method according to claim 7, further comprising the steps of:

assigning a high weighting value for the average gray level value and the most-frequent gray level value;

assigning a middle weighting value for the gray level range value;

assigning a low weighting value for the minimum gray level value, the maximum gray level value, the center value and the intermediate gray level value; and generating the second discriminating factor based on the weighted average gray level value, the weighted most-frequent gray level value, the weighted gray level range value, the weighted minimum gray level value, the weighted maximum gray level value, the weighted center value and the weighted intermediate gray level value.

9. The method according to claim 4, wherein the image at the current frame is discriminated as a still image when the first and second discriminating factors fall within a predetermined range, and the image at the current frame is discriminated as a moving image when the first and second discriminating factors fall outside the predetermined range.

10. The method according to claim 4, further comprising the steps of:

controlling a back light to generate light of various degrees of brightness based on the second discriminating factor when the image at the current frame is discriminated as a moving image; and controlling the back light to generate light of a predetermined brightness when the image at the current frame is discriminated as a still image.

11. The method according to claim 1, wherein the liquid crystal display device is driven based on the first data when the image at the current frame is discriminated as a still image and the liquid crystal display device is driven based on the second data when the image at the current frame is discriminated as a moving image.

12. The driving apparatus for a liquid crystal display device, comprising:

an image signal modulator receiving first data for a current frame, retrieving brightness histograms for at least two frames prior to the current frame to generate an average histogram, and generating second data for the current frame based on the average histogram;

a back light controller generating a brightness control signal based on the average histogram;

an image discriminator comparing the histogram for the current frame with the average histogram to determine whether an image at the current frame is a moving image or a still image;

a selector receiving the first data and the second data and selectively outputting one of the first data and the second data based on the discrimination result; and an image area selector extracting a portion of the brightness components for the first data for a current frame to be inputted to the image signal modulator, wherein the image signal modulator stores the histograms for at least two frames that are immediately prior to the current frame, assigns weighting values to the stored histograms; and converting the histograms assigned with the weighting values into average values to produce the average histogram.

13. The driving apparatus according to claim 12, wherein the portion of the brightness components for the first data corresponds to image data for a center display area of a liquid crystal display panel.

14. The driving apparatus according to claim 12, wherein the image discriminator includes:

a first image discriminating factor detector extracting a first image discriminating factor based on the histogram for the current frame; and a second image discriminating factor detector extracting a second image discriminating factor from the average histogram.

15. The driving apparatus according to claim 14, wherein the back light controller generates the brightness control signal based on the second discriminating factor when the first and second discriminating factors fall outside of a predetermined range, and generates the brightness control signal based on a predetermined brightness when the first and second discriminating factors fall within the predetermined range.

16. The driving apparatus according to claim 14, wherein the selector outputs the first data when the first and second discriminating factors fall within a predetermined range, and outputs the second data when the first and second discriminating factors fall outside of the predetermined range.

17. The driving apparatus according to claim 14, wherein the image signal modulator includes:

a brightness/color separator separating the first data for the current frame into brightness components and chrominance components;

a histogram analyzer converting the brightness components into a histogram;

a storage storing histograms for at least two frames analyzed by the histogram analyzer;

a weighting value assigner assigning a weighting value to each of the stored histograms;

an average value calculator generating the average histogram based on the histograms for the at least two frames stored in the storage;

a data processor modulating the brightness components extracted from the brightness/color separator using said average histogram; and a brightness/color mixer for generating the second data based on the modulated brightness components and the chrominance components.

18. The driving apparatus according to claim 17, wherein the first and second image discriminating factors respectively include an average gray level value, a most-frequent gray level value, a center gray level value, a maximum gray level value, a minimum gray level value, a gray level range value and an intermediate gray level value.

19. The driving apparatus according to claim 17, further comprising a weighting value assigner for assigning a weighting value to the first image discriminating factor and the second image discriminating factor.

20. The driving apparatus according to claim 19, wherein the weighting value assigner assigns a high weighting value for the average gray level value and the most-frequent gray level value; assigns a middle weighting value for the gray level range value; and assigns a low weighting value for the minimum gray level value, the maximum gray level value, the center value and the intermediate gray level value.

* * * * *